United States Patent [19]

Howard

[11] 3,998,450

[45] Dec. 21, 1976

[54] SORTING APPARATUS

[75] Inventor: Anthony Howard, Rochester, N.Y.

[73] Assignee: Xerox Corporation, Stamford, Conn.

[22] Filed: Oct. 7, 1975

[21] Appl. No.: 620,431

Related U.S. Application Data

[63] Continuation of Ser. No. 339,675, March 9, 1973, abandoned.

[52] U.S. Cl. ..... 271/173; 271/207

[51] Int. Cl.[2] ..... B65H 29/60; B65H 31/24

[58] Field of Search ..... 271/173, 64, 65, 66, 271/186, 185, 9, 207; 270/58, 59, 60

[56] References Cited

UNITED STATES PATENTS

| | | | |
|---|---|---|---|
| 2,919,917 | 1/1960 | Worswick | 271/173 |
| 3,709,492 | 1/1973 | Baker et al. | 271/173 |
| 3,721,435 | 3/1973 | Zanders | 271/173 |
| 3,774,902 | 11/1973 | Schulze | 271/64 X |
| 3,788,640 | 1/1974 | Stemmle | 271/64 |
| 3,851,872 | 12/1974 | Gerbasi | 271/173 |
| 3,866,904 | 2/1975 | Stemmle | 271/173 |

OTHER PUBLICATIONS

Simpson, G. I., Jr. "Duplex Copier Incorporating Sorter–Collator," *IBM Technical Disclosure Bulletin*, vol. 14, No. 5, Oct. 1971, p. 1453.

*Primary Examiner*—Evon C. Blunk
*Assistant Examiner*—Bruce H. Stoner, Jr.

[57] ABSTRACT

Sorting apparatus for collating both simplex and duplex copies from a copying machine. Tray assemblies receive the copy sheet from a moving deflector advanced past the inlet to the tray members. The deflector is pivotable to direct sheets towards the right or left side of the tray members for duplex and simplex sorting modes of operation. A sheet guide assembly serves to retain the stack of sheets on the right or left side of each tray member. The tray members are slideable to enable opening a wide inlet to a sheet entering the tray assembly. The tray members are pushed sideways on guides by an indexing apparatus moving in conjunction with the deflector.

6 Claims, 4 Drawing Figures

SORTING APPARATUS

This is a continuation of application Ser. No 339,675, filed Mar. 9, 1973, now abandoned.

This invention relates to apparatus for sorting both simplex and duplex copies from a high speed copier/duplicator into collated sets.

In copier/duplicator systems sorters normally have included sorting bin modular units with a multitude of trays as described in U.S. Pat. Nos. 3,561,754, 3,356,362, 2,876,008, 2,951,697, and 3,076,647. While these constructions are satisfactory they have certain disadvantages such as the number of trays that can be accommodated and the ease at which the trays can be unloaded.

The present invention is, generally speaking, a sorter/collator adapted for universal usage with copiers duplicators including simplex and duplex sorting modes of operation. The compact arrangement of the bins or trays and the manner in which they receive copy sheets enables a highly reliable sorte/collator system for rapid distribution of copy sheets in collated sets.

It is therefore a general object of this invention to improve sorting of copy sheets.

It is another object of this invention to enable the distribution of copy sheets in collated sets in a reliable manner.

It is still a further object of the invention to enable sorting copy sheets in both simplex and duplex modes of operation.

It is still a further object of the invention to enable sorting copy sheets into an array of closely spaced trays.

It is still a further object of the invention to eliminate the need for a separate sheet inverting device when sorting sheets in both simplex and duplex sorting modes of operation.

The above and added advantages of the present invention will be more apparent after reading the following detailed description which refers to accompanying drawings in which.

Figure 1:
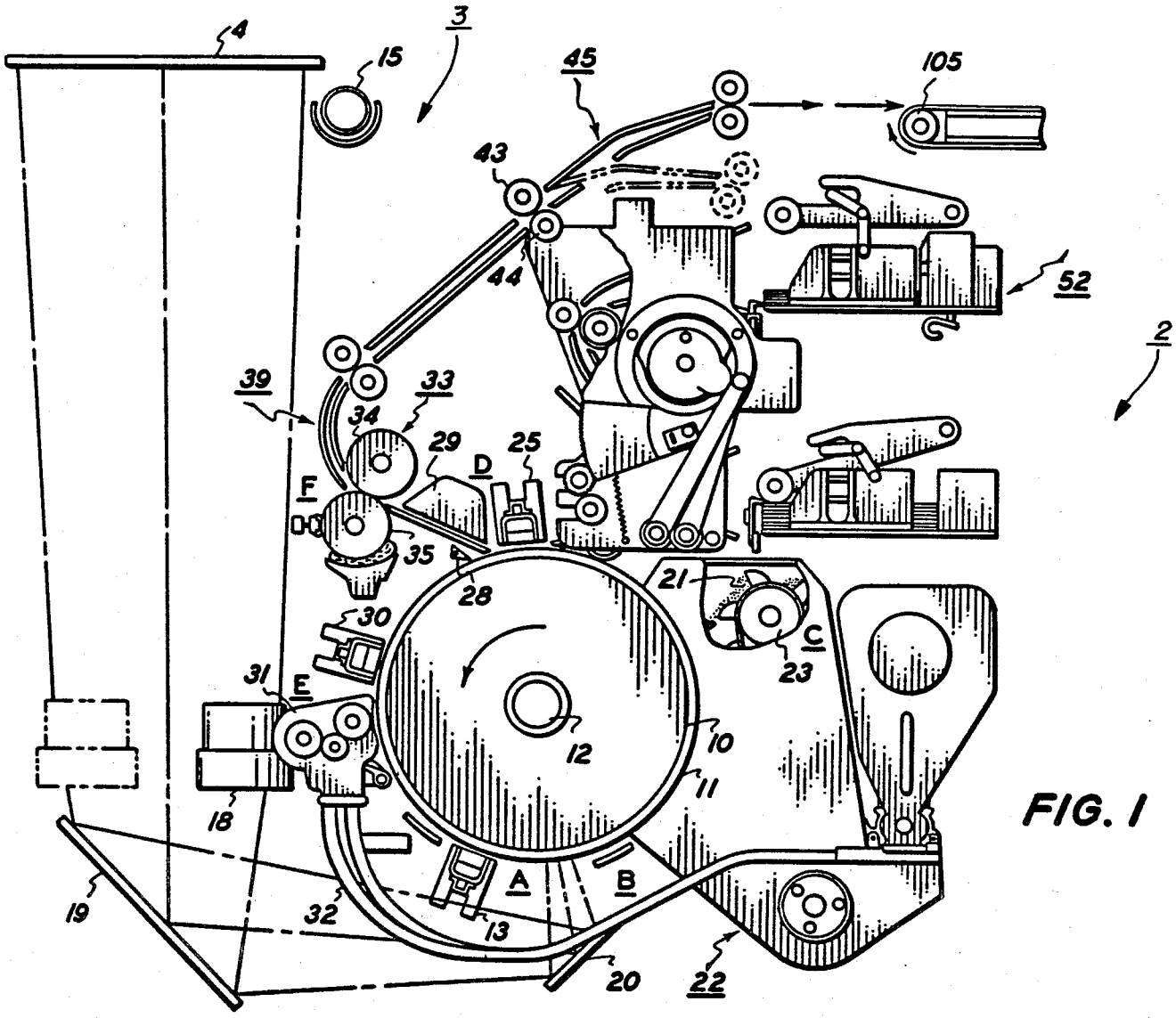
FIG. 1 is a schematic view of a xerographic copier/duplicator machine producing copies to be sorted by sorting apparatus according to the present invention.
Figure 2A:
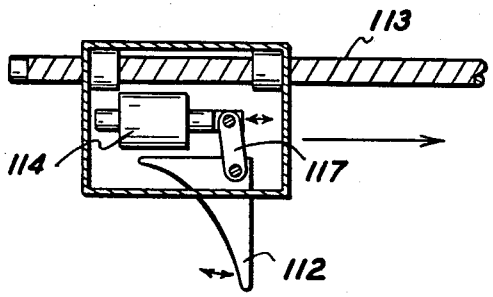
FIG. 2A is an exploded view of the deflector.
Figure 2:
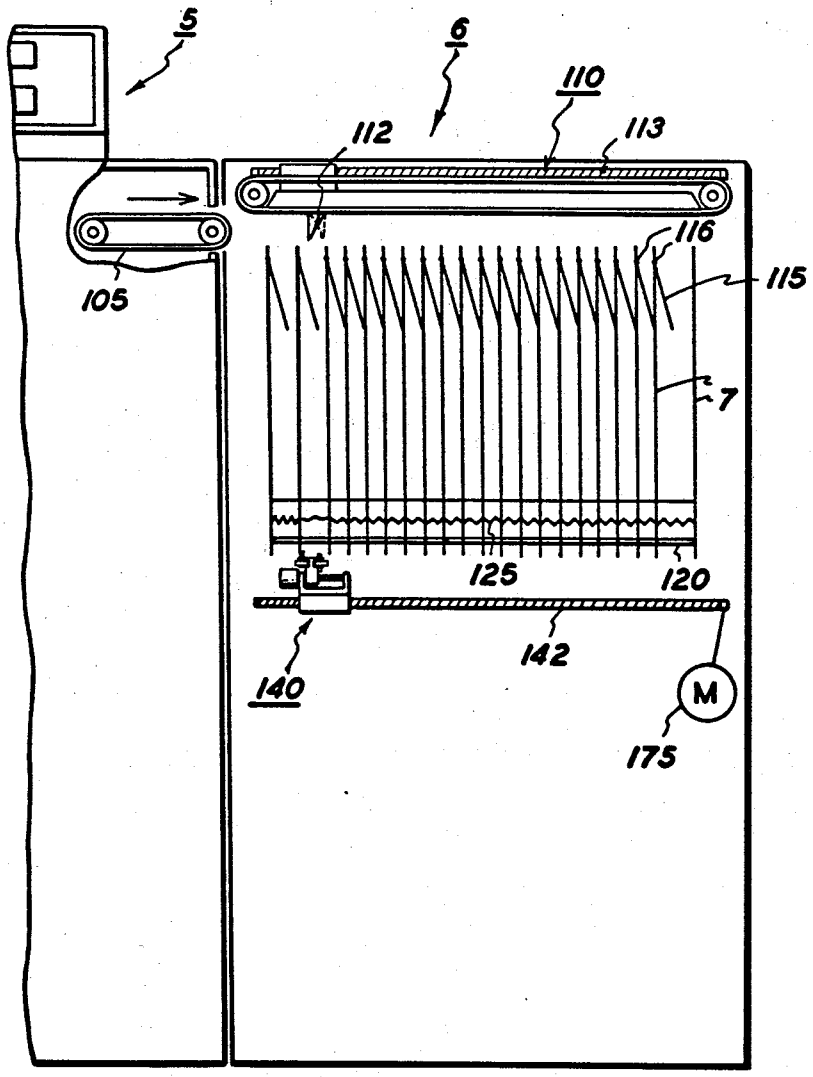
FIG. 2 is a side view of sorting apparatus according to the present invention.

FIG. 1 shows a schematic of the copier/duplicator system generally designed 2 including a copier machine 3, which is a high speed copier/duplicator capable of producing simplex or duplex copies at the option of a machine operator. The copier machine 3 has a platen 4 for receiving documents to be reproduced, and a control panel 5 (FIG. 2) which includes various control knobs, buttons, and switches for selecting various modes of operation such as simplex and duplex copies and the number of copies to be reproduced. In accordance with the invention a sorting apparatus 6 distributes copy sheets into tray assemblies 7 (FIG. 2).

The copier duplicator system includes an automatic xerographic apparatus which includes a photosensitive plate including a photoconductive layer 10 that is placed over a conductive backing. The plate is formed in the shape of a drum 11 and the drum mounted upon a shaft 12 that is journaled for rotation in the machine frame. Basically, the xerographic drum is rotated in the direction indicated so as to pass sequentially through a series of xerographic processing stations. The photosensitive drum and the xerographic processing apparatus are driven at predetermined speeds relative to each other from a drive system (not shown) and the operation thereof coordinated in order to produce proper cooperation of the various processing mechanisms.

The original, to be reproduced, is placed upon a transparant horizontally supported platen 4 and the original scanned by means of a moving optical scanning system and to produce a flowing light image of the original. The scanning system includes an elongated horizontal extended aperture lamp 15 and a moveable lens element 18.

The lamp and lens element moves in coordination across the object supported upon the platen to focus successive incremental bans of illumination reflected from the object onto the moving drum surface at synchronous speeds therewith. The optical path is folded by means of a pair of image mirrors 19 and 20 interposed between the lens and the drum surface, the drum is first uniformly charged by means of a corona generator 13 positioned on charging station A. Under the influence of the flowing light image, the uniformly charged photoconductive surface is selectively dissipated in the non-image areas to form what is commonly known as a "latent electrostatic image."

The latent electrostatic image is carried on the drum surface from the exposure station into the developing station C. The developing station is primarily comprised of a developer housing 22 adapted to support a supply of two-component developer material 21 therein. The developer material is transported by means of a bucket system 23 from the bottom of the developer housing to an elevated position where the material is delivered into the active development zone. The developer material is caused to flow downwardly in contact with the upwardly moving drum surface under closely controlled conditions wherein charged toner particles are attracted from the developer mix into the image areas on the plate surface thus making the image visible.

The moving drum surface next transports the developed xerographic image to a transfer station D. Cut sheets of final support material are also moved into the transfer station, the backside of the copy sheet is sprayed with an ion discharge from a transfer corotron 25 inducing on the sheet a charge having a polarity and magnitude sufficient to attract the toner material from the drum surface to the final support material. This induced charge also electrostatically tacks the final support material to the drum surface. In order to remove the copy sheet from the drum surface a stripper finger 28 is positioned downstream from the transfer corotron. The finger is arranged to move between the drum surface and the copy sheet and lifts the sheet from the drum surface and the copy sheet is directed along a predetermined path of travel into contact with a stationary vacuum transport 29.

Although a preponderance of the toner material is transferred from the drum surface to the copy sheet during the transfer process, invariably some residual toner remains behind on the drum surface after transfer. This residual toner is transported on the drum surface into a cleaning station E where it is brought under the influence of a cleaning corotron 30 adapted to neutralize the electrostatic charge tending to hold the residual toner to the drum surface. The neutralized toner is mechanically cleaned from the drum surface by means of a brush or the like and the toner collected within a housing 31. A conveyor moving in an endless loop through tubes 32 transports the collected residual toner back to the developer housing where it is deposited within the developed mix so that it can be once again reused in the xerographic developing process.

The copy sheet, which has been removed from the drum surface after the transfer operation, is moved along stationary transport 29 into fusing station F. The fuser 33 is basically made up of an upper fuser roll 34 and a lower fuser roll 35 mounted in operative relation to each other and arranged to coact so as to support a sheet of material in pressure driving contact therebetween. The lower roll is heated. As the heated roll is rotated in the direction indicated the heated surface of the lower roll is pressed into intimate contact with the image face of the support sheet. Mechanical and heat energy transported from the roll surface to the support sheet permanently bond the toner particles to the support material.

Upon leaving the fuser, the fixed copy sheet is passed through a curvalinear sheet guide system, generally referred to as 39, into cooperating advancing rolls 43 and 44. At this point, depending on the mode of operation selected, the copy sheet is either forwarded directly to the sorter or into the upper supply tray 52 my means of a moveable sheet guide 45 before entering the sorter.

It is believed that the foregoing description is sufficient for purposes of the present application to show the general operation of a xerographic reproducing machine. For a more detailed explanation of the copier/duplicator xerographic components reference is made to U.S. Pat. No. 3,645,615 entitled Copying Apparatus.

Figure 3:
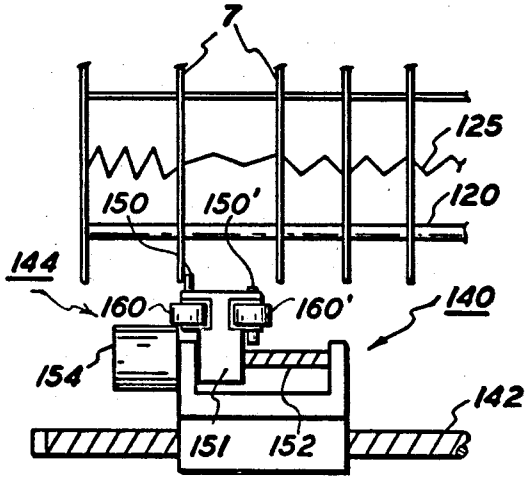
FIG. 3 is an exploded view of the tray separation indexing apparatus.

Sorting Apparatus (FIGS 2 and 3)

Sorting apparatus 6 includes a vacuum transport assembly 110 which carries a traveling deflector member 112 which moves past a horizontal array of vertical tray assemblies 7 on a lead screw 113. Each tray assembly 7 has a pivotable sheet guide assembly (FIG. 3) including a plate member 115 connected to a pin 116 which is pivotably mounted to an associated tray assembly. Deflector member 112 is pivotably mounted so as to have two positions as shown in solid and dashed lines (FIG. 2) to direct copy sheets towards either the right or left side of the tray assemblies and is actuated by solenoid 114 through a linkage 117. The position of the plate member 115 corresponds to the position of the deflector member 112 to guide sheets right or left upon actuation of deflector member 112 depending on whether the machine is in the simplex or duplex sorting mode of operation which is selected on control panel 5. Thus, for simplex mode of operation where copy sheets have side one face up the sheets are directed to the left side of the tray assemblies looking at FIG. 2. For duplex mode of operation the sheets have side one face down are directed to the right side of the tray assemblies looking at FIG. 2.

As the sheets enter the tray assemblies, each tray assembly shifts or spreads to enable an extended or opened inlet to the tray assembly receiving a sheet. To accomplish this the tray assemblies are slideably supported on guide members 120 positioned below a dust cover 125. Located below the guide members is a tray separator indexing assembly 140 including a lead screw 142 which carries separator indexing apparatus 144. Separator indexing apparatus 144 includes engagement pawls 150 and 150' mounted on a traveling head 151 which is driven by a lead screw 152. The engagement pawl 150 is solenoid actuated by solenoid 160 up or down to slide the tray assemblies 7 to the right and the engagement pawl 150' is solenoid actuated up or down by solenoid 160 to slide the tray assemblies to the left. A reversible drive motor 154 is energized to push a selected tray assembly which is receiving a sheet and that reverses to index to the next adjacent tray assembly. After distributing a sheet, the separator indexing apparatus 144 is moved to the next indexed position adjacent the succeeding tray assembly by rotating lead screw 142 which is driven incrementally by a reversible drive motor 175. The deflector member 112 and tray indexing apparatus move in timed relation. By this structure the tray assemblies are indexed to the right or left to produce collated copy sets. Unloading of the collated sets is facilitated by the compact tray arrangement. After a run is completed the deflector member 112 and separator indexing assembly move to a start position to commence another cycle, etc. until the sorting operation is completed. The first and last tray assemblies are spaced further apart for use as overflow trays.

While there have been shown and described and pointed out the fundamental novel features of the invention as applied to a preferred embodiment, it will be understood that various omission and substitutions and changes in the form and details of the device illustrated and in its operation may be made by those skilled in the art without departing from the spirit of the invention.

What is claimed is:

1. Sorting apparatus comprising:

a frame;

a horizontal array of closely spaced parallel vertically extending tray members slidably supported on said frame;

conveyor means including a moving deflector member for directing sheets into a selected tray member;

tray indexing apparatus moving in the same direction and in timed relation with said deflector member to slide each tray member to increase the inlet opening of the tray member receiving a sheet;

wherein said tray indexing apparatus includes at least one pawl member carried on a traveling head member which is reversibly driven;

wherein said pawl member is solenoid actuated to move into position to engage a tray member.

2. Apparatus according to claim 1 wherein said deflector member is pivotable to move from a first position to direct sheets to one side of the tray assembly to a second position to direct sheets to the other side thereof.

3. Apparatus according to claim 1 wherein said tray indexing apparatus includes two pawl members each pushing the tray members in a different direction depending on the direction of sorting sheets.

4. Apparatus according to claim 1 wherein the tray members on the ends have normally wider openings than the remaining tray members.

5. Sorting apparatus comprising:

a frame;

a horizontal array of closely spaced parallel vertically extending tray members slidably supported on said frame;

conveyor means including a moving deflector member for directing sheets into a selected tray member;

tray indexing apparatus moving in the same direction and in timed relation with said deflector member to slide each tray member to increase the inlet opening of the tray member receiving a sheet;

wherein said tray indexing apparatus includes at least one actuated member carried on a traveling member;

wherein said actuated member is solenoid actuated to move into position to engage a tray member.

6. Apparatus for receiving and stacking in a desired order, a series of simplex and duplex copy sheets traveling along a predetermined path from a copier machine capable of simplex and duplex operation, said apparatus comprising:

a sheet receiving bin positioned to receive sheets traveling along said predetermined path, said bin including a first sheet supporting member for supporting suquentially received simplex sheets with side one directed towards said first support member, and a second sheet supporting member for supporting sequentially received duplex sheets with side two directed towards said first supporting member, deflector means to direct each sheet from said path into the interior of said bin toward either said first or second sheet supporting member, said means being actuatable to direct each sheet towards the particular sheet supporting member dependent upon whether simplex or duplex operation is desired.

* * * * *